US005582119A

United States Patent [19]

Barkdoll

[11] Patent Number: 5,582,119

[45] Date of Patent: Dec. 10, 1996

[54] TREATMENT OF EXPLOSIVE WASTE

[75] Inventor: Michael P. Barkdoll, Knoxville, Tenn.

[73] Assignee: International Technology Corporation, Torrance, Calif.

[21] Appl. No.: 415,531

[22] Filed: Mar. 30, 1995

[51] Int. Cl.[6] ..... F23G 7/00

[52] U.S. Cl. ..... 110/346; 110/237; 588/202

[58] Field of Search ..... 110/237, 346, 110/245; 588/202, 203

[56] References Cited

U.S. PATENT DOCUMENTS 5,419,862 5/1995 Hampel ..... 588/202 X 5,495,812 3/1996 Schulze ..... 110/237

*Primary Examiner*—Henry A. Bennett

*Assistant Examiner*—Susanne C. Tinker

*Attorney, Agent, or Firm*—Luedeka, Neely & Graham, P.C.

[57] ABSTRACT

The invention described herein provides a method and apparatus for the treatment of explosive waste. The method involves the use of a vessel containing a hot granular bed such as sand to ignite the waste and to dampen explosive forces generated by the ignition of the waste. When the waste contains non-combustible components, the granular bed serves to decrease the force of impact of the non-combustible materials on the vessel walls thereby increasing the life of the vessel and as a media for collection of the non-combustible materials. The granular bed may be removed from the chamber, the non-combustible material separated, and the bed returned in a continuous or intermittent recycle for an efficient operation which conserves the bed material.

28 Claims, 1 Drawing Sheet

TREATMENT OF EXPLOSIVE WASTE

FIELD OF THE INVENTION

This invention relates to a system and method for destroying explosive waste.

BACKGROUND

During the production and use of ordnances, pyrotechnics, incendiary devices and explosive materials there is a certain amount of unusable and highly explosive waste generated. The nature of the explosive waste requires that extreme care be taken to properly dispose of this waste.

In the past, large open areas were required for destruction of explosive wastes. These open areas, however, do not lend themselves to collection and treatment of toxic and hazardous materials which result when the waste is destroyed.

Rotary kilns have also been used to dispose of explosive materials. Rotary kilns typically handle small quantities of completely combustible waste and require a large volume of air to assure complete combustion and removal of toxic and hazardous gases from the kiln. Accordingly, the exhaust gas from the rotary kilns must be treated to remove any toxic or hazardous materials generated during the destruction of these such wastes. In order to treat the exhaust gas, large scale secondary treatment systems are required.

Rotary kiln incinerators are not well suited for handling explosive waste containing any appreciable amount of non-combustible components. Non-combustible components may be propelled through the inlet or exit of a rotary kiln during the destruction process thus creating a hazard. The impact force of any projectile may damage or destroy the kiln.

Still another method for treating explosive wastes is disclosed in U.S. Pat. No. 3903,814 to Altekruse. This method involves the use of a refractory-lined vessel containing a combustible heat source for igniting the charge. As the charge descends through the vessel, it is combusted in a fireball above the heat source. The refractory lining of the vessel provides retention of the heat energy above the heat source to assure combustion of the waste before it contacts the heat source. Because the vessel is refractory-lined, the vessel must be of a size sufficient to prevent the fireball from contacting the vessel walls during destruction in order to increase the life of the refractory lining. Only charges essentially free of non-combustible components can be handled with such a refractory-lined system. While this method may be suitable for completely combustible waste, waste containing any appreciable amount of non-combustible components cannot be handled without damage to the refractory lining. Once damaged, replacement of the refractory lining is a costly and time consuming procedure.

An object of the invention, therefore, is to provide a system for the destruction of ordnances, incendiary devices, pyrotechnics and explosives materials.

Another object of the invention is to provide a thermal incineration method and apparatus for effectively destroying explosive waste in a manner which minimizes hazards and equipment damage associated with prior art techniques.

Yet another object of the invention is to provide a system and method suitable for thermally destroying explosive waste containing non-combustible components.

Still another object of the invention is to provide an environmentally acceptable method for thermally destroying explosive waste containing non-combustible components while at the same time providing a means to collect and remove non-combustible components from the incinerator.

Other objects and advantages of the invention will be evident from the ensuing description and appended claims.

SUMMARY OF THE INVENTION

With regard to the above and other objects, the present invention provides a method and related apparatus for treating ordnances, pyrotechnics, incendiary devices, explosive materials, and the like hereinafter referred to as "explosive waste." The terminology "explosive waste" is adopted for convenience and is not intended to exclude materials that undergo thermal destruction by mechanisms other than by explosion such as by combustion or pyrolysis. Furthermore, the explosive material may not be waste in the normal sense of the word since it may include material that is suitable for its intended purpose, but must be destroyed.

The method comprises providing an impact resistant vessel defining an interior chamber having an upper portion, a lower portion and at least one opening for introduction of the explosive waste into the chamber. The lower portion of the vessel contains a granular bed, preferably a non-combustible granular bed. The granular bed is heated to a suitable ignition temperature, preferably above about 550° C., and the explosive waste is introduced into the vessel so as to cause the explosive waste to contact, and preferably become embedded in, the heated granular bed. Heat energy from the bed is then transferred to the explosive waste causing the waste to undergo thermal destruction such as by explosion, followed by combustion of gases and solids liberated in the explosion. The granular bed not only provides the heat source for igniting the waste, but also dampens explosive forces associated with the ignition of the waste and provides a media for collecting non-combustible materials.

As used herein, the terms "ignite" and "ignition" refer to any burning, combustion, pyrolysis or explosion processes whereby a portion of the ignited material is destroyed and/or reduced to a substantially nonhazardous or non-objectional form. As used herein, the term "non-combustible" means any material introduced with the waste which is not vaporized or combusted at the process temperature such as, for example, metals, non-flammable plastics, ceramics and the like.

A particular advantage of the method of the invention is the ability to handle explosive waste without the need to first remove any projectiles or non-combustible components from the waste. As the waste contacts the granular bed, the bed heats the waste to the ignition temperature and also dampens or absorbs explosive forces resulting from ignition of the waste. In many cases, the granular bed may also act to capture non-combustible components thereby reducing the incidence of impact of the non-combustible components on the vessel walls. This not only increases the life of the vessel, but also reduces hazards associated with any high velocity projectiles that may be generated during the process.

Another advantage of the invention is the high on-stream time relative to other explosive waste destruction systems. The high on-stream time is due in part to the design of the destruction vessel which preferably uses a cast or roll-formed metal shell without a refractory lining. Since the vessel may omit a refractory lining, many explosive wastes can be destroyed without removing projectiles which may otherwise damage a refractory lining. Furthermore, by providing vessel walls free of friable materials, material costs, downtime and repair expenses are minimized.

The invention also relates to a system for treating explosive waste. The system comprises a vessel having impact resistant walls defining a substantially closed chamber having an upper portion and a lower portion and at least one opening communicating exteriorly into the chamber through the vessel for introduction of explosive waste into the chamber. The vessel contains a granular bed, preferably a non-combustible granular material such as sand, in the lower portion of the chamber for heating the explosive waste to a destruction temperature. A feed conveyor is provided for conveying explosive waste through the opening into the chamber so as to deposit the waste into or onto the bed so that at least a portion of the waste material is embedded in the bed. The granular bed is heated to a temperature sufficient to ignite the waste and any suitable heater device may be used for this purpose, although an external induction heater may be advantageous in many applications.

The system of the invention also preferably includes a blower for introducing hot air/purge gas into the vessel for combustion and for sweeping toxic and other combustion effluent gases and particulates from the vessel. The purge gas and collected combustion effluent and entrained particulates exit the vessel through an exhaust duct provided in the upper portion of the vessel. In a preferred embodiment, the exhaust duct directs the exhaust gas through a particulate removal device for removal of particulate material and/or a secondary treatment unit for combusting any hazardous gases exiting the vessel. Since only a sufficient amount of air to assure complete combustion of the waste and to purge the chamber in the vessel is required with the system of the present invention, commercially available air handling units, incinerators, and particulate collection devices may be used in conjunction with the treatment vessel to neutralize or remove hazardous components from the exhaust gas stream. This eliminates the need for custom designed components to handle large volumes of exhaust gases and particulates generated during the destruction procedure.

Explosive waste which may be destroyed by the system and method of this invention include, by way of example and not by way of limitation, explosives and ordnance containing compounds such as amatol 60/40 (60 wt. % ammonium nitrate and 40 wt. % trinitrotoluene), baronal (50 wt. % barium nitrate, 35 wt. % trinitrotoluene and 15 wt. % aluminum), compound B (60 wt. % cyclonite and 40 wt. % trinitrotoluene), C-4 (91 wt. % cyclonite and 9 wt. % plasticizer), ammonium picrate, H-6 (45 wt. % cyclonite, 30 wt. % trinitrotoluene, 20 wt. % aluminum and 5 wt. % D-2 wax), HBX-1 (40 wt. % cyclonite, 38 wt. % trinitrotoluene, 17 wt. % aluminum and 5 wt. % D-2 wax), lead azide, HMX, lead styphnate, mercury fulminate, nitroglycerine, nitroguanidine, octol 70/30 (70 wt. % HMX, 30 wt. % trinitrotoluene), PETN, pentolite 50/50 (50 wt. % PETN, 50 wt. % trinitrotoluene), picric acid, cyclonite, silver azide, tetryl, trinitrotoluene, torpex (42 wt. % RDX, 40 wt. % trinitrotoluene and 18 wt. % aluminum), tritonal (80 wt. % trinitrotoluene, 20 wt. % aluminum) and combinations of two or more of the foregoing. Any or all of the foregoing and other such materials may also contain non-combustible components such as projectiles, ceramics, plastics and metal casings.

DESCRIPTION OF THE DRAWING

Other features and advantages of the invention will be evident from the ensuing detailed description and claims considered in conjunction with the single FIGURE which is an illustration, not to scale, of a system in accordance with a preferred embodiment of the invention illustrating the main features thereof.

DETAILED DESCRIPTION OF THE PREFERRED EMBODIMENTS

Figure 1:
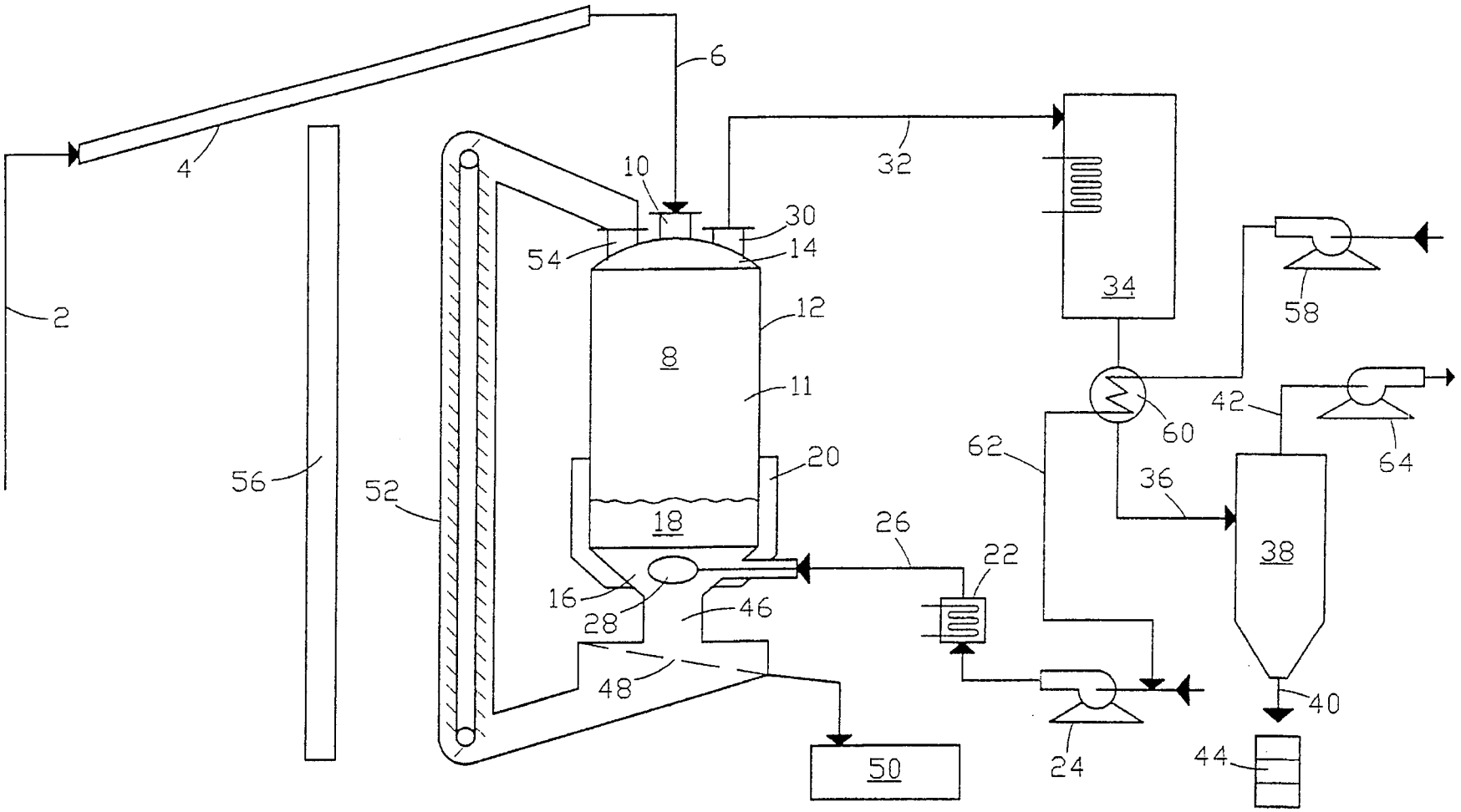

With reference now to the drawing, and in accordance with a preferred embodiment of the invention, explosive waste 2 is conveyed by conveying device 4 through inlet duct 6 into a substantially closed chamber 8 through opening 10 in the upper portion of a treatment vessel 11. Impact resistant chamber walls 12, dished head 14 and conical bottom section 16 of vessel 11 define within chamber 8 an upper portion and a lower portion for receiving and treating the explosive waste. The chamber walls 12 are preferably provided by curvelinear cast or rolled steel sections having a thickness ranging from about 0.5 inches to about 3.0 inches (1.27 to 7.62 cm) and welded or otherwise attached together so as to provide the vessel with an upright cylindrical configuration. The diameter of the vessel is preferably within the range of from about 6 to about 8 feet (about 1.8 to about 2.4 meters) and the vessel may have a height of from about 10 feet to about 15 feet (3.0 to about 4.5 meters). However, any size or vessel configuration may be used so long as chamber 8 has sufficient volume for practicing the invention. It is particularly preferred that the impact resistant walls 12 contain no refractory lining.

A bed of granular material 18 is provided in the lower portion of the chamber 8 for heating the explosive waste to its ignition temperature upon contact therewith and for collecting non-combustible material. The granular material 18 also absorbs or dampens explosive forces that may result upon ignition of the waste. By damping the explosive forces, the number of impacts and the force of such impacts on the chamber walls 12 of non-combustible components in the waste is minimized. Thus, non-combustible components of the waste such as metal shells, fragments and like may be propelled into the granular bed as the material is deposited in the chamber 8 or as a result of the force of explosion associated with ignition of the waste.

During operation of the system of the invention, explosive waste is preferably fed by conveyor 4 through duct 6 and opening 10 into a cross-sectional center region of the chamber 8 so that the waste is deposited on or into the bed of hot granular material 18 for ignition thereof. The conveyor 4 may be fixed so that it deposits the waste into the chamber 8 from essentially the same location, or it may be movable so that the waste is deposited into or onto the bed at different points. Varying the feed location of the conveyor 4 may be used to insure that the granular material contacted by the waste maintains a depth of at least about 3.5 feet (about 1 meter) throughout the granular bed. However for most hot granular materials, the angle of repose of the hot materials and the vibrations caused by the destruction of the explosive waste effectively levels the granular materials so that varying the feed location is not required.

It is particularly preferred that the explosive waste be deposited on or into the bed in the chamber so that destruction of the waste takes place remote from the chamber walls 12 and within the granular bed 18. Accordingly, the explosive waste is preferably deposited into the chamber 8 near the cross-sectional center of the chamber 8 so that it is maintained by the granular material 18 in a position remote from the chamber walls 12. In some instances, the explosive waste may actually be buried in the granular material 18 in order that the granular material may substantially dampen explosive forces and intercept or reduce the velocity of any projectile propelled from the material.

It is preferred that the upper section of the chamber 8 have sufficient volume to allow for some oxidation of the fumes or vapors emitted from the explosive waste and granular bed. By providing a sufficient volume for oxidation, smaller secondary treatment units may be used to destroy any hazardous or toxic components remaining in the exhaust gases.

In order to heat the granular material to a temperature required for ignition of the waste, an external heating source 20 is provided and is preferably attached to an external lower portion of the chamber walls 12 adjacent the bed of granular material 18 within the chamber 8. The external heating source 20 is preferably an electric resistance or induction heating device. Supplemental heat energy may also be provided by a supplemental heater 22 and blower 24 via gas inlet duct 26 through distributor 28 positioned within or below the granular bed 18. The supplemental heater 22 is used to assist in initially heating the granular material 18 to the desired ignition temperature and to assist in maintaining the bed at the desired ignition temperature. Typically, once the granular bed reaches the desired operating temperature, heater 20 is sufficient to maintain the desired operating temperature. Accordingly, the air flow rate through heater 22 will be greatly reduced, thus providing only a small flow of sweep gas to move unwanted gaseous components and particulates from the chamber 8.

While exhaust gases from destruction of the waste may exit the vessel through opening 10 in the upper portion of the vessel, it is preferred to provide the vessel with a separate exhaust gas outlet opening 30 in the dished head 14. When opening 30 is not provided, appropriate valving techniques attached to duct 6 may be used to direct exhaust gases from the vessel and away from inlet duct 6 during the destruction operation. During ignition and/or destruction of the waste, exhaust gases containing toxic or hazardous materials and/or particulates are swept from the chamber 8 through exhaust opening 30 into duct 32 by a sweep gas which may be introduced through gas inlet duct 26 and distributor 28 in the granular bed 18. The exhaust gases swept from the chamber are preferably conducted to a secondary treatment system.

Combustion or sweep gas may be provided to assure complete combustion of any flammable material in the chamber 8 and to provide even distribution of heat throughout the granular bed 18 as well as to sweep any hazardous or flammable gases and entrained particulate matter from the destruction chamber 8 via exhaust opening 30. Gas flow rates through the chamber 8 in the range of from about 80 to about 150 CFM (about 2.2 to about 4.2 $m^3$/min.) are typically needed for 6 to 8 foot diameter vessels. It is preferred that the sweep gas rate be sufficiently low to prevent fluidization of the granular bed. Accordingly, for other granular materials, more or less gas flow may be used as a sweep gas.

Upon initial start up of the treatment system, the combustion or sweep gas is preferably preheated using heater 22 which may be fuel fired, electric or a heat exchanger using a heat transfer fluid. The combustion or sweep gas entering heater 22 is provided via blower 24.

The secondary treatment system comprises a secondary treatment unit 34 for combusting hazardous or toxic materials which may be present in the exhaust gas stream exiting the chamber 8. Any type of commercially available fume incinerator or electrically heated chamber may be used for the secondary treatment unit 34. The size of the secondary treatment unit 34 is determined by the amount of hazardous gases or vapors exiting chamber 8 via duct 32 and the amount of combustion and sweep gas entering the vessel via gas inlet duct 26 and air distributor 28.

The gases exiting the secondary treatment unit 34 may be exhausted to the atmosphere or, if they contain entrained particulate material, may be conducted by duct 36 to a particulate collection device 38 such as a bag house, cyclone, electrostatic precipitator, particulate filter, scrubber, high temperature particulate filter and the like. The particulate removal device 38 is used to separate particulates 40 from the gases and vapors thereby providing an essentially particulate free atmospheric exhaust stream 42. Once collected the particulate material 40 may be disposed of by collecting the particulate material in drums 44 or other waste collection devices. Although it is preferred to thermally destroy any hazardous or toxic gases prior to the particulate collection device 38, it will be appreciated that the particulate collection device 38 may also be positioned to remove particulate material prior to the secondary treatment unit 34.

The treatment system of the present invention is advantageously adapted to handle explosive waste having appreciable amounts of non-combustible components such as metal shell casings, certain plastics or ceramics, projectiles and the like. In order to remove metals and other non-combustible components from the granular bed, the system is preferably provided with a granular material outlet 46 below the granular bed 18 for removing and feeding the granular material through a separation device 48. Any non-combustible components introduced to the system with the waste and contained in the granular bed may be removed by separation device 48 and collected in disposal container 50. The separation device 48 is preferably a screening or sifting device such as a vibrating foraminous metal plate, mesh metal screen or the like, having openings large enough to allow passage of the granular material therethrough yet small enough to retain and separate the non-combustible components from the granular material. The screened granular material may then be recycled to the chamber 8 via recycle conveying device 52 through recycle opening 54 in dished head 14. The recycle conveying device 52 may be a pneumatic conveying device, bucket elevator and the like, and may also include provision for reheating the granules before they are reintroduced into the vessel, such as an open flame burner located in the conduit or a burner whose exhaust is directed into the conduit.

For protection of personnel, the entire system or any portion thereof may be housed within the confines of a blast resistant wall 56 or other blast resistant structure. The blast resistant wall 56 may be provided by reinforced concrete or cement blocks as well as cast or rolled metal.

In order to further reduce the energy requirements for the system, a heat recovery blower 58 may optionally be provided to produce heated air via conduit 62 and gas to gas heat exchanger 60 for flow to the inlet side of blower 24. The air in conduit 62 may be heated with the gases in duct 36 which are exhausted from secondary treatment unit 34 or any other hot gas source in the system.

It is also preferred to provide suction blower 64 for maintaining a subatmospheric pressure in the chamber 8, secondary treatment unit 34 and particulate collection device 38. By adjusting the flow rate through blower 64, the amount of fumes or vapors escaping from the system before treatment to remove any hazardous or toxic components will be minimized. Accordingly, blower 64 should be sized to maintain at least a slight subatmospheric pressure in all portions of the system. Suitable subatmospheric pressures may ranges from a few inches of water to several pounds per square inch negative pressure.

An important feature of the invention is the use of a substantially closed vessel containing a heated bed of granular, preferably non-combustible material to heat the explosive waste to its ignition temperature. The granular material may be selected from refractory pellets, sand and silicon-iron balls or particulates containing aluminum oxide and/or silicon dioxide. Useful granular refractory materials include alumina, beryllium oxide, calcium oxide, magnesium oxide, silicon carbide, titanium oxide, zirconium oxide and mixtures of two or more of the foregoing having a melting point higher than about 3000° F. (about 1650° C.) and a thermal conductivity of greater than about 0.2 BTU/ft-hr,°F. (0.413 cal/m-sec,°C).. Of the above, the most preferred granular material is sand due to its ready availability and low cost. In the alternative, a combustible granular material may also be used. Such combustible materials include coke, carbon and the like.

The mass of granular material in the lower portion of the vessel should be sufficient to provide a source of heat for the ignition of the explosive waste, which source retains heat to a degree sufficient to reduce the need for a large supplemental heating source. Accordingly, the mass of granular material and its thermal conductivity are selected to provide a suitable heat source. For a vessel having a diameter of from about 6 to about 8 feet (about 1.8 to about 2.4 meters), about 100 cubic feet (2.83 cubic meters) of granular material, most preferably sand, is preferred to provide a suitable depth of granular material and an efficient heat retaining source. It is preferred that the volume of the granular material range from about 15 to about 35 percent of the total volume of the chamber 8, and most preferably about 20 percent of the total volume of the chamber when sand is used. Generally speaking, this translates to a bed height of from about 33 to about 50 percent of the total height of the chamber.

In order to assure that the integrity of the vessel walls are maintained and to accommodate gaseous expansions associated with the explosions, it is preferred that the diameter of the chamber relative to the size of the explosive waste ignited in the chamber be within the ratio of from about 10:1 to about 50:1, and most preferably from about 15:1 to about 20:1; or that the diameter be otherwise selected to insure a sufficient volume in relation to the expected explosive force to absorb the gas volume increase without equipment damage. A particularly preferred chamber diameter is within the range of from about 6 to about 8 feet (about 1.8 to about 2.4 meters) and a particularly preferred shell thickness is from about 0.75 inches to about 1.5 inches (about 1.9 cm to about 3.8 cm). While the foregoing represent the preferred diameters and shell thicknesses, it will be recognized by those of ordinary skill that the chamber wall thickness is dependent upon the type of waste being fed to the chamber to be destroyed.

Another advantage of the system of the present invention is the use of an external heating source 20 to initially heat and maintain the granular bed at the desired ordnance ignition temperature. Since the heating source 20 for igniting the explosive waste is external to the chamber 8, no breach of the chamber walls above the granular bed is required. Hence, the integrity of the system and the safety upon ignition of the waste is enhanced. The integrity of the system also minimizes the entrance of infiltration air and the release of vapors or fumes from the system.

By using an electric heating source rather than an internally fired fuel source to heat the granular material 18, there is also reduced gas flow within chamber 8 and consequently reduced exhaust gas and/or vapors exiting the chamber. Fuel type heating sources require the presence of combustion air as well as sweep air to move hazardous gases and vapors resulting from the ignition of the explosive waste out of a combustion unit. In contrast, the system and methods of this invention require only an amount of air sufficient to assure complete combustion of the explosive waste as well as to sweep any hazardous gases and vapors from the chamber 8. The minimal amount of combustion air and sweep gas required for the system of the invention means that smaller scale secondary treatment unit 34 and/or particulate removal devices 38 may be used to remove hazardous materials from the effluent gases from the vessel. The low sweep gas flow also minimizes the operating costs of the secondary treatment unit 34 and particulate collection device 38 on the exhaust gas stream existing the chamber.

In order to further illustrate the invention, the following example is given. This example is given for illustrative purposes and is not intended to limit the invention in any way.

EXAMPLE

Waste ordnances are fed at the rate of 18 to 30 pounds per hour (8 to 14 kg per hour) to a 6 foot diameter (1.8 meters) by 8 foot high (2.4 meters) cast steel chamber having a dished upper head and a conical bottom and having a shell thickness of 2 inches (5 cm). The rate of feed of the waste ordnances is controlled by the manual placement of the waste ordnances on a feed conveyer. The conveyed ordnances are dropped into the chamber through double mechanical slide gates whereby they fall directly into the chamber near the cross-sectional center of a sand bed.

The lower portion of the chamber contains about 100 cubic feet (2.8 cubic meters) of sand. The sand is heated via resistance heaters attached externally to the conically shaped lower section of the chamber adjacent the sand bed. The external resistance heaters are sufficient to heat the sand to 1200° F. (650° C.). Also provided is an external 138,000 BTU per hour electric heater for initially heating the sand and for heating 100 CFM (2.8 cubic meters per minute) of sweep gas to about 1600° F. (about 870° C.).

Exhaust gases from the chamber, at a rate of 100 CFM (2.8 cubic meters per minute) and about 1200° F. (650° C.), are directed to a secondary combustion unit whereby any remaining hazardous or combustible material in the chamber exhaust is thermally decomposed at a temperature of about 1600° F. (about 870° C.). The gases exiting the secondary combustion unit are cooled with a gas to gas heat exchanger to a temperature of about 400° F. (204° C.) before being fed to a bag house for removal of any entrained particulate matter.

After about 8 hours of operation a slide gate near the bottom portion of the chamber is opened and the sand flows through a screen to remove any non-combustible components. The non-combustible components are collected and disposed of or recovered (such as brass) and the screened sand is recycled to the chamber via a bucket conveyer.

Having described the invention and its preferred embodiments, it will be recognized that the invention is subject to variations within the spirit and scope of the appended claims.

What is claimed is:

1. A method for thermally destroying explosive waste comprising:

providing an impact resistant substantially closed vessel having an upper portion, a lower portion, at least one opening in the upper portion for introduction of explosive waste and containing a substantially non-combustible granular bed in the lower portion thereof;

heating the granular bed to a temperature of at least about 550° C.; and depositing the waste into the vessel so as to cause the waste to contact the granular bed whereupon heat energy from the bed is transferred to the waste causing the waste to ignite and wherein the bed dampens explosive forces associated with the ignition.

2. The method of claim 1 further comprising exhausting gases from the vessel generated from ignition of the waste.

3. The method of claim 2 further comprising treating the gases exhausted from the vessel to remove particulate material and to destroy any toxic or hazardous components.

4. The method of claim 3 wherein the toxic or hazardous components are removed by heating the exhaust gases to a temperature sufficient to destroy the components.

5. The method of claim 1 wherein the waste contains non-combustible materials and the method further comprises removing the granular material from the lower portion of the vessel and separating non-combustible materials therefrom and returning the granular material to the vessel.

6. The method of claim 1 wherein the granular bed is indirectly heated with an external induction heater.

7. The method of claim 1 wherein the impact resistant vessel has a diameter of at least about 4 feet, a height of at least about 10 feet and a granular bed depth of at least about 4 feet.

8. The method of claim 1 wherein the waste is deposited into a central region of the vessel by a conveying device so that the waste is deposited generally into the center of the granular bed.

9. The method of claim 1 wherein the granular bed is sand.

10. A method for treating explosive waste containing non-combustible components comprising:

providing an impact resistant substantially closed vessel having an upper portion, a lower portion, at least one opening in the upper portion for introduction of explosive waste containing non-combustible components, the vessel having a granular bed in the lower portion thereof;

heating the granular bed to a temperature of at least about 550° C.; and introducing the waste to the vessel in a manner sufficient to cause the waste to contact the granular bed whereupon heat energy from the bed is transferred to the waste causing the waste to ignite and wherein the bed dampens explosive forces associated with ignition of the waste.

11. The method of claim 10 further comprising exhausting gases from the vessel generated from ignition of the waste.

12. The method of claim 11 further comprising treating the gases exhausted from the vessel to remove particulate material and to destroy any toxic or hazardous components.

13. The method of claim 12 wherein the toxic or hazardous components are removed by heating the exhaust gases to a temperature sufficient to destroy the components.

14. The method of claim 10 wherein the method further comprises removing the granular material from the lower portion of the vessel and separating non-combustible components therefrom and returning the granular material to the vessel.

15. The method of claim 10 wherein the granular bed is indirectly preheated with hot air.

16. The method of claim 10 wherein the impact resistant vessel has a diameter of at least about 4 feet, a height of at least about 10 feet and a granular bed depth of at least about 4 feet.

17. The method of claim 10 wherein the explosive waste is deposited into a central region of the vessel by a conveying device so that the waste is deposited generally into the center of the granular bed.

18. A system for treating explosive waste comprising:

a vessel having impact resistant walls defining a substantially closed chamber having an upper portion and a lower portion and at least one opening communicating exteriorly into the chamber through the vessel for introduction of explosive waste into the chamber;

a substantially non-combustible granular bed in the lower portion of the chamber for heating the waste to a destruction temperature;

a feed conveyor for conveying the waste through the opening into the chamber so as to deposit the waste into or onto the bed; and a heater for heating the granular bed to a temperature sufficient to ignite the waste.

19. The system of claim 18 further comprising an exhaust duct in the upper portion of the vessel for exhausting gases therefrom.

20. The system of claim 19 further comprising a particulate removal device for removing particulate material exiting the vessel through the exhaust duct.

21. The system of claim 20 further comprising a burner or electrical heating element for incinerating hazardous gases exiting the vessel, the particulate removal device or both the vessel and the particulate removal device.

22. The system of claim 18 further comprising an outlet in the lower portion of the vessel for removing the granular bed and non-combustible material from the vessel.

23. The system of claim 18 wherein the granular bed consists essentially of sand.

24. The system of claim 23 further comprising a sand conveyor and screening device for screening sand removed from the vessel and for recycling sand to the vessel.

25. The system of claim 18 wherein the impact resistant walls are formed from cast steel.

26. The system of claim 18 further comprising a blast wall for shielding personnel from the vessel.

27. The system of claim 18 wherein the vessel has a diameter to height ratio of at least about 0.4:1.

28. The system of claim 18 wherein the granular bed has a depth of at least about 4 feet.

* * * * *